US008684425B2

(12) United States Patent
Nagaoka

(10) Patent No.: US 8,684,425 B2
(45) Date of Patent: Apr. 1, 2014

(54) VEHICLE DOOR LATCH APPARATUS

(75) Inventor: Tomoharu Nagaoka, Kanagawa (JP)

(73) Assignee: Mitsui Kinzoku Act Corporation, Yokohama-shi (JP)

( * ) Notice: Subject to any disclaimer, the term of this patent is extended or adjusted under 35 U.S.C. 154(b) by 156 days.

(21) Appl. No.: 13/235,924

(22) Filed: Sep. 19, 2011

(65) Prior Publication Data

US 2012/0074719 A1 Mar. 29, 2012

(30) Foreign Application Priority Data

Sep. 27, 2010 (JP) ..... 2010-214746

(51) Int. Cl.
*E05B 3/00* (2006.01)

(52) U.S. Cl.
USPC .. 292/336.3; 292/201; 292/216; 292/DIG. 23

(58) Field of Classification Search
CPC ..... E05B 81/14; E05B 85/26; E05B 81/06
USPC ..... 292/201, 216, DIG. 23
See application file for complete search history.

(56) References Cited

U.S. PATENT DOCUMENTS

| | | | | | |
|---|---|---|---|---|---|
| 4,575,138 | A * | 3/1986 | Nakamura et al. | ..... | 292/216 |
| 5,476,294 | A * | 12/1995 | Menke | ..... | 292/216 |
| 5,605,363 | A * | 2/1997 | Kapes | ..... | 292/196 |
| 6,062,613 | A * | 5/2000 | Jung et al. | ..... | 292/201 |
| 7,438,331 | B2 * | 10/2008 | Wakatsuki | ..... | 292/216 |
| 2003/0094818 | A1 * | 5/2003 | Tomaszewski et al. | ..... | 292/195 |
| 2006/0087129 | A1 * | 4/2006 | Gotou et al. | ..... | 292/216 |
| 2006/0186675 | A1 * | 8/2006 | Suzumura et al. | ..... | 292/216 |
| 2009/0236863 | A1 * | 9/2009 | Akizuki et al. | ..... | 292/201 |

FOREIGN PATENT DOCUMENTS

| | | | |
|---|---|---|---|
| JP | 2001-271530 | A | 10/2001 |
| JP | 2002-81247 | A | 3/2002 |
| JP | 3875472 B2 | A | 11/2006 |
| WO | WO 2011/114898 | A1 | 9/2011 |

* cited by examiner

*Primary Examiner* — Kristina Fulton
*Assistant Examiner* — Nathan Cumar
(74) *Attorney, Agent, or Firm* — Foley & Lardner LLP

(57) ABSTRACT

A child lever includes an operation portion, which is supported slidably and rotatably on a cover fixed to a casing, and which passes through a panel hole provided in a door to be exposed to the outside. The child lever is allowed to move to an unlocking position, in which the child lever is allowed to rotate together with an inside lever so as to transmit rotation of the inside lever to an opening member, and a locking position, in which the child lever is not allowed to rotate together with the inside lever so as not to transmit rotation of the inside lever to the opening member.

9 Claims, 10 Drawing Sheets

VEHICLE DOOR LATCH APPARATUS

CROSS-REFERENCE TO RELATED APPLICATIONS

This application claims priority from Japanese Patent Application No. 2010-214746 filed on Sep. 27, 2010, the entire subject-matter of which is incorporated herein by reference.

BACKGROUND OF THE INVENTION

1. Field of the Invention

The present invention relates to a vehicle door latch apparatus having a childproof lock mechanism.

2. Description of the Related Art

In a vehicle door latch apparatus, Japanese Patent No. 3875472 discloses a vehicle door latch apparatus having a childproof lock mechanism.

In a configuration of the childproof lock mechanism of the vehicle door latch apparatus having the childproof lock mechanism disclosed in Japanese Patent No. 3875472, an elongate hole provided in a child lever having an operating portion, which passes through a panel hole provided in a door panel, is fitted slidably and rotatably on a rotating shaft that pivotally supports an inside lever that is rotatable based on a door opening operation of an inside handle provided on an inner side of a door. Accordingly, the child lever is displaced in a straight-line fashion between an unlocking position where the door opening operation of the inside handle can be transmitted to an opening member and a locking position where the door opening operation cannot be transmitted to the opening member.

However, in the vehicle door latch apparatus disclosed in Japanese Patent No. 3875472, even when the child lever is in the locking position, the child lever rotates in the opening direction together with the inside lever based on the door opening operation of the inside handle. This is not preferable in obtaining a smooth idle operation (an operation which disables the transmission of rotation of the inside lever in the opening direction to the opening member) and an ensured child lock state in the child lock state in which the child lever is in the locking position. Namely, it is preferable to involve as few operating portions operating in association with the opening operation of the inside handle as possible in obtaining the smooth idle operation and the ensured child lock state.

SUMMARY OF THE INVENTION

Illustrative aspects of the invention provide a vehicle door latch apparatus which can obtain a smooth idle operation and an ensured child lock state.

According to a first aspect of the invention, there is provided a vehicle door latch apparatus that enables a door to be opened by operating an opening member to release a latch in accordance with a door opening operation of an inside door handle provided inside a passenger compartment, the vehicle door latch apparatus comprising: an inside lever, which is pivotally supported by a first base member, and which is rotatable in accordance with the door opening operation of the inside door handle; and a child lever that comprises an operation portion, which is supported slidably and rotatably on a second base member, and which is adapted to pass through a panel hole provided in the door to be exposed to an outside, wherein the child lever is movable to: an unlocking position where the child lever is allowed to rotate together with the inside lever so as to transmit the rotation of the inside lever to the opening member; and a locking position where the child lever is not allowed to rotate together with the inside lever so as not to transmit the rotation of the inside lever to the opening member.

According thereto, in the childproof lock locked state when the child lever is in the locking position, no action is taken place in the child lever irrespective of rotation of the inside lever. Therefore, the smooth idle operation becomes possible and the childproof lock locked state can be ensured.

According to a second aspect of the invention, in the vehicle door latch apparatus, wherein the child lever comprises a connecting projecting portion, which is allowed to be brought into abutment with the inside lever so that the child lever can rotate together with the inside lever when the child lever is in the unlocking position, and which is not allowed to be brought into abutment with the inside lever irrespective of rotation of the inside lever when the child lever is in the locking position.

According thereto, when in the childproof lock unlocked state, the child lever is allowed to rotate together with the inside lever, and when in the childproof lock locked state, even when the inside lever rotates, the child lever can be made not to rotate.

According to a third aspect of the invention, in the vehicle door latch apparatus, wherein the second base member comprises a straight-line guide portion that faces a rotating plane of the inside lever, and wherein the child lever is supported in the guide portion slidably and rotatably.

According thereto, the child lever can be supported on the second base member with a simple configuration.

According to a fourth aspect of the invention, in the vehicle door latch apparatus, wherein the guide portion comprises: a portion that faces a rotation center of the inside lever; and a portion that is offset from the rotation center, and wherein when the child lever is in the unlocking position, the child lever is held rotatably in the portion that faces the rotation center of the inside lever.

According thereto, the child lever can smoothly rotate together with the inside lever concentrically with the inside lever in the unlocking position.

According to a fifth aspect of the invention, in the vehicle door latch apparatus, wherein the operation portion of the child lever is provided at a portion which moves along a longitudinal direction of the guide portion when the child lever rotates together with the inside lever in the unlocking position. According to a sixth aspect of the invention, in the vehicle door latch apparatus, wherein the operation portion of the child lever is provided at a rotation center of the child lever when the child lever rotates together with the inside lever in the unlocking position According thereto, in the fifth aspect, the panel hole provided in the door to permit the movement of the operation portion can be formed into a straight line, thereby making it possible to improve the external appearance thereof. Further, in the sixth aspect, the panel hole can be made smaller than that in the fifth aspect.

According to a seventh aspect of the invention, in the vehicle door latch apparatus, wherein the second base member comprises an elastic portion that is adapted to elastically hold the child lever in the unlocking position and the locking position by being brought into elastic abutment with the child lever.

According thereto, the child lever can be held in the unlocking position and the locking position with the simple configuration.

According to an eighth aspect of the invention, in the vehicle latch apparatus, wherein when the child lever is in the locking position, the child lever is brought into abutment with the second base member so as to be prevented from rotating.

According thereto, the child lever is prevented from rotating in the opening direction when the child lever is in the locking position. Therefore, the childproof lock locked state can be ensured further.

According to the aspects of the invention, in the locking position, the child lever does not rotate together with the inside lever. Thus, the smooth idle operation becomes possible in the childproof lock locked state, and the ensured childproof lock locked state can be obtained.

DETAILED DESCRIPTION OF THE PREFERRED EMBODIMENTS

Hereinafter, an embodiment of the invention will be described with reference to the drawings.

Figure 1:
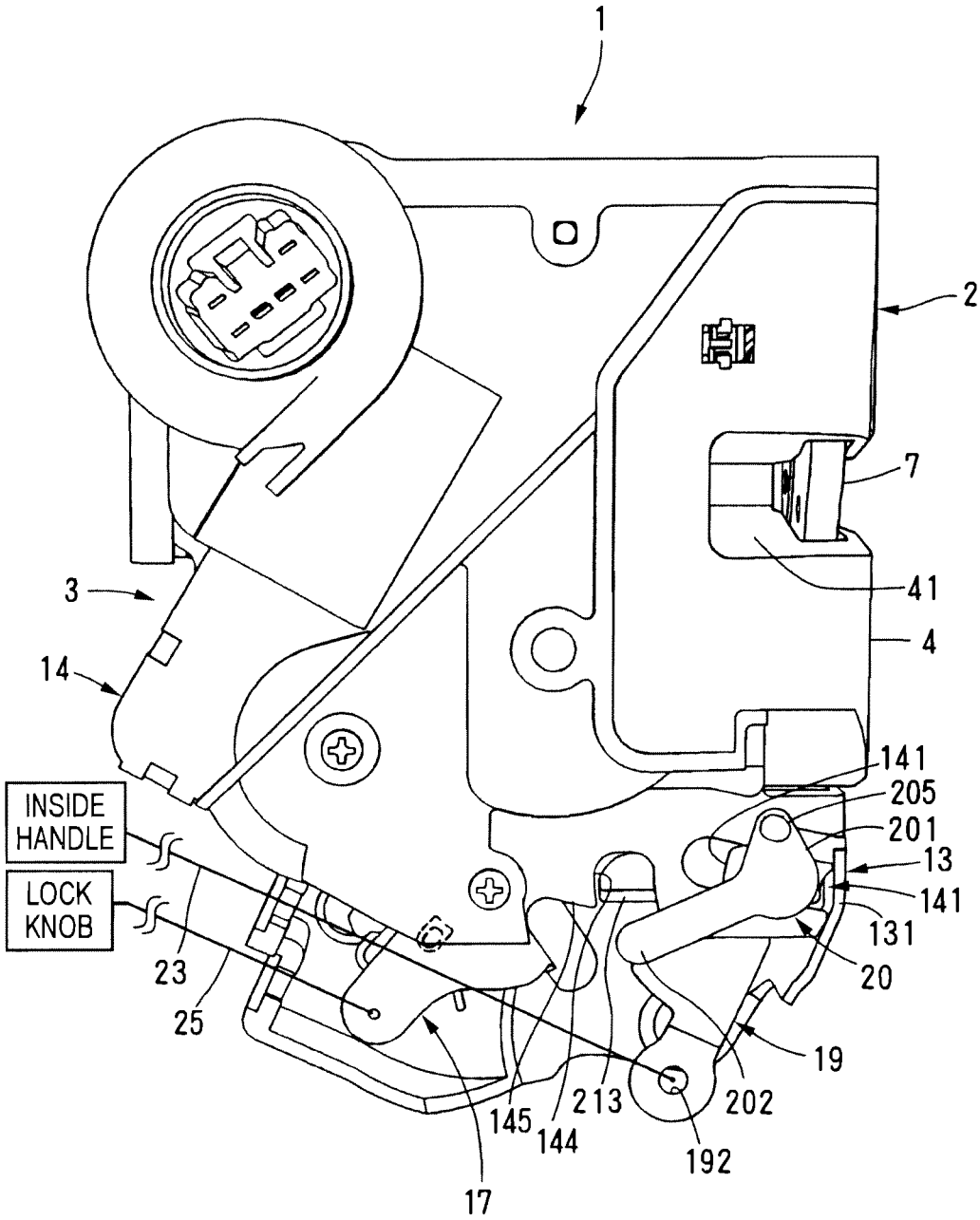
FIG. 1 is a front view of a door latch apparatus according to the invention.

FIG. 1 is a front view of a door latch apparatus 1 as viewed from an inside of a passenger compartment. The door latch apparatus 1 includes a meshing unit 2 and an operation unit 3. The meshing unit 2 is attached to a rear end portion within a rear side door (hereinafter, referred to as a door) of a motor vehicle so as to hold the door in a closed state. The operation unit 3 is attached to the meshing unit 2.

Figure 2:
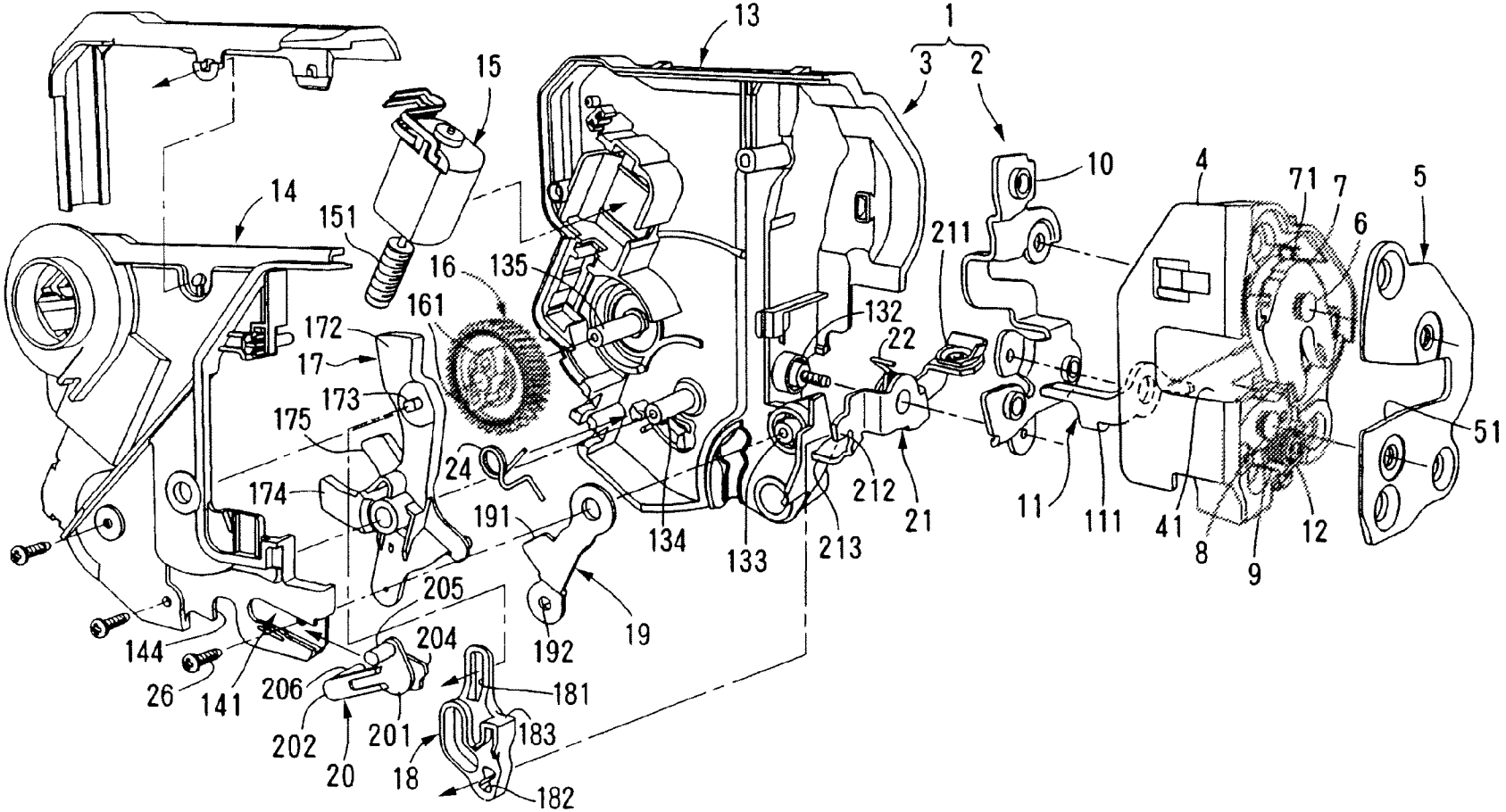
FIG. 2 is an exploded perspective view of the door latch apparatus.

As shown in FIG. 2, the meshing unit 2 includes a body 4, a cover plate 5, a latch 7, a ratchet 9, a back plate 10 and an opening lever 11. The body 4 is made of a synthetic resin and is fixed in place within the door by a bolt (not shown). The cover plate 5 is made of a metal and closes an opening in the body 4 on a rear side (a right side in FIG. 2) thereof. The latch 7 is pivotally supported by a latch shaft 6 that is oriented in a front-to-rear direction (a horizontal direction in FIG. 2) between the body 4 and the cover plate 5. The latch 7 is adapted to be engaged with a striker (not shown) which is secured to a vehicle body side when the door is closed. The ratchet 9 is pivotally supported by a ratchet shaft 8 oriented in the front-to-rear direction between the body 4 and the cover plate 5. The ratchet 9 is adapted to be engaged with and disengaged from the latch 7. The back plate 10 is made of a metal and is fixed to a front surface side (a left side in FIG. 2) of the body 4. The opening lever 11 is supported pivotally and concentrically with the ratchet 9 and can rotate together with the ratchet 9.

When the door is closed, the striker on the vehicle body side enters striker entrance grooves 41, 51 provided in the body 4 and the cover plate 5, respectively, from an inner side of a passenger compartment to thereby be brought into engagement with the latch 7. The latch 7 rotates about the latch shaft 6 against a pressing force of a spring 71 which is wound round the latch shaft 6. The ratchet 9 is brought into engagement with the latch 7 by a pressing force of a spring 12, which is supported below the ratchet 9, so as to prevent the rotation of the latch 7 to thereby hold the door in a closed state.

Figure 3:
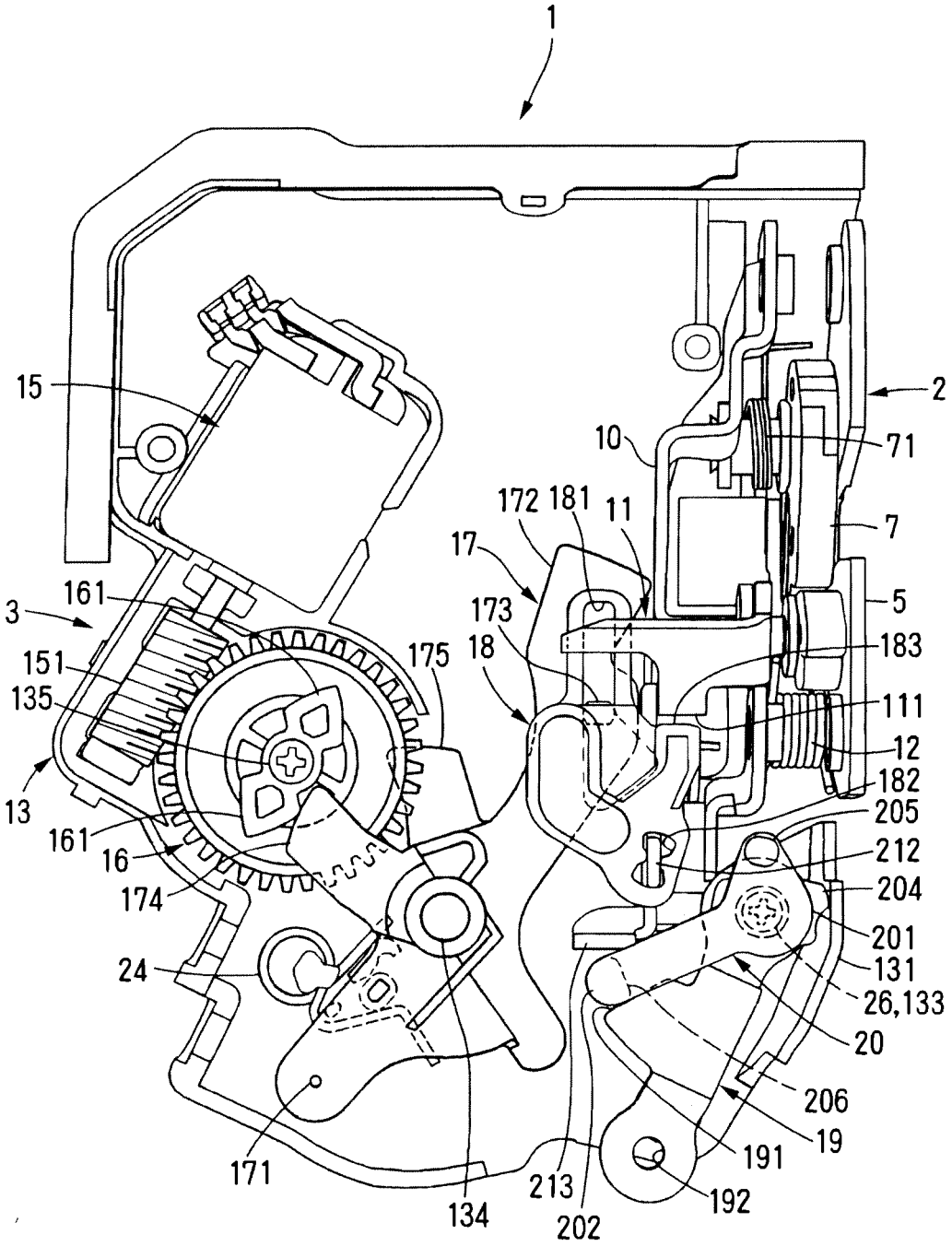
FIG. 3 is a front view showing an interior structure of the door latch apparatus when a lock lever and an opening link are in a locking position and a child lever is in an unlocking position.
Figure 4:
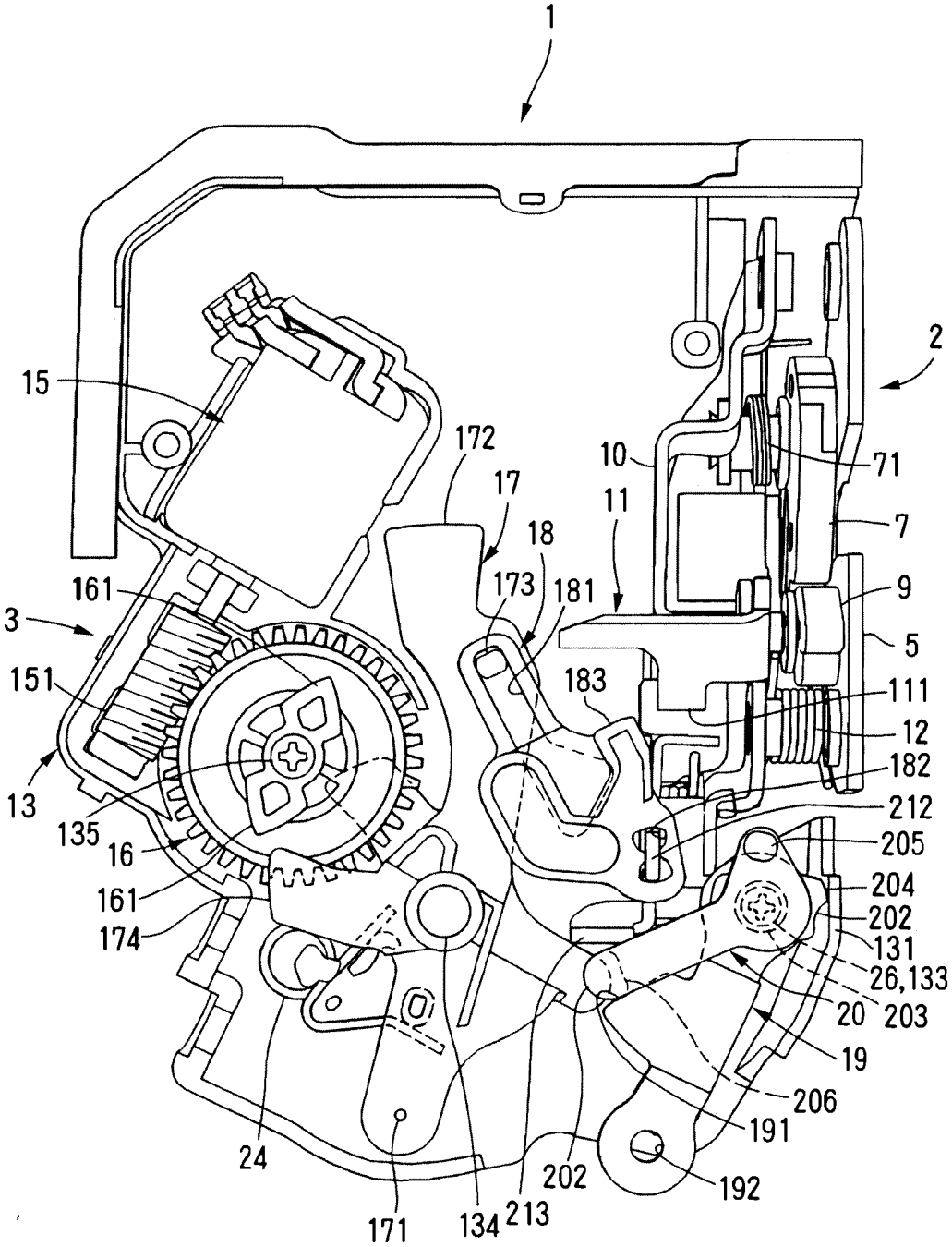
FIG. 4 is a front view showing the interior structure of the door latch apparatus when the lock lever and the opening link are in a locking position and the child lever is in the unlocking position.

As shown in FIGS. 2 to 4, the operation unit 3 includes a casing 13 (one example of a first base member), a cover 14 (one example of a second base member), a motor 15 that can rotate forwards and backwards, a worm wheel 16, a lock lever 17, an opening link 18, an inside lever 19, a child lever 20 and an outside lever 21. Incidentally, in FIGS. 3 and 4, to clarify interior structures of the meshing unit 2 and the operation unit 3, the body 4 and the body cover 14 are omitted. Incidentally, the opening lever 11, the inside lever 19 and the outside lever 21 configures one example of an opening member.

The casing 13 has a substantially L-shape when viewed from thereabove and is attached to a front side of the body 4. The cover 14 is fixed to the casing 13 so as to close an opening in the casing 13 which is oriented towards the inside of the passenger compartment.

A guide portion 141 is provided at a lower portion of the cover 14 so as to support the child lever 20. The guide portion 141 is formed by an elongate groove, which extends in a straight-line fashion in the front-to-rear direction so as to follow a rotating plane of the inside lever 19, and which is opened on a passenger compartment side thereof. Further, an escape hole 144 is provided at the front of the guide portion 141 in the cover 14 so as to permit the rotation of the child lever 20 in an opening direction (a clockwise direction in FIG. 1) when the child lever 20 is in an unlocking position (which will be described later).

Figure 11:
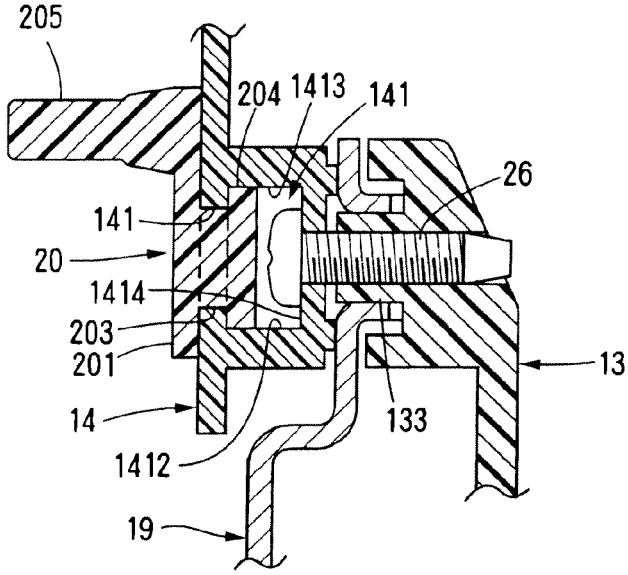
FIG. 11 is a sectional view taken along the line XI-XI in FIG. 9.
Figure 12:
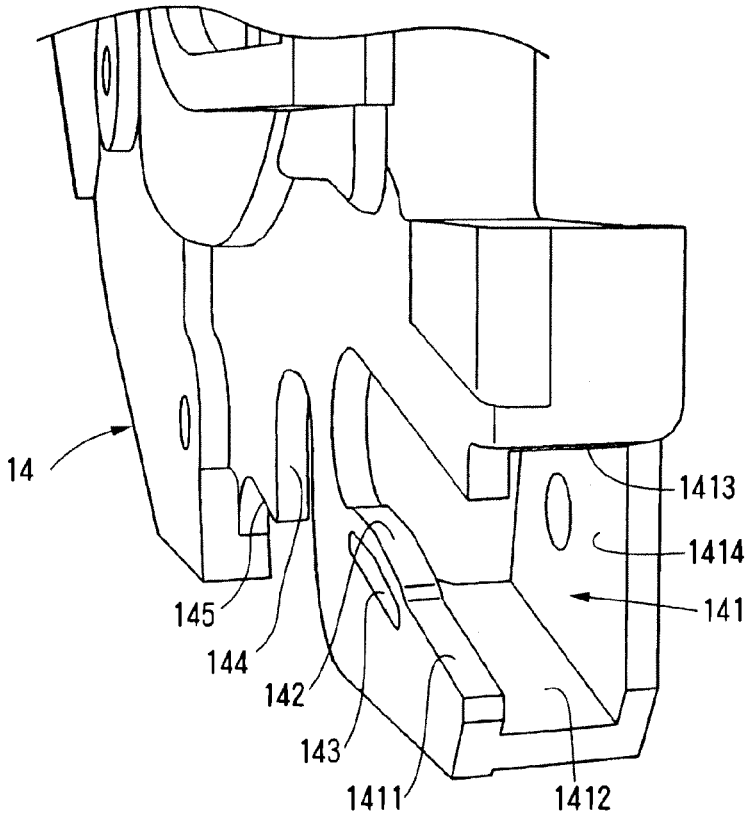
FIG. 12 is a perspective view of a main part of a cover.

As clearly shown in FIGS. 11, 12, the guide portion 141 includes a passenger compartment side opening 1411, a bottom surface portion 1412, a ceiling surface portion 1413 that faces the bottom surface portion 1412, and a side wall portion 1414 that faces the opening 1411. The side wall portion 1414 is provided so as to face an axial direction of a shaft portion 133 that is oriented towards the inside of the passenger compartment to pivotally support the inside lever 19 on the casing 13. By this configuration, the guide portion 141 is formed so as to include: a portion (a rear portion of the guide portion 141) that faces the rotating plane of the inside lever 19 and coincides with a rotation center of the inside lever 19; and a portion (a front portion of the guide portion 141) that is offset from the rotation center. A slider portion 204 (which will be described later) of the child lever 20 is slidably inserted into a space in the guide portion 141 defined by the bottom surface portion 1412, the ceiling surface portion 1413 and the side wall portion 1414. A lower edge of the opening 1411 projects slightly further upwards than the bottom surface portion 1412, and an upper edge of the opening 1411 projects slightly further downwards than the ceiling surface portion 1413.

Figure 8:
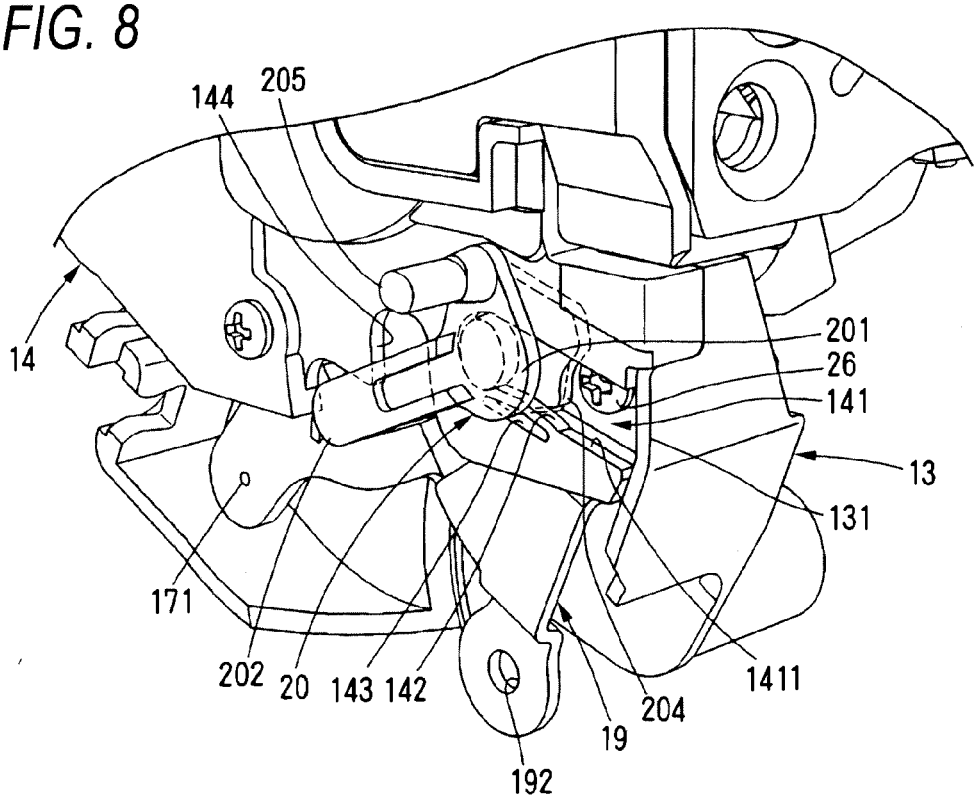
FIG. 8 is an enlarged perspective view of the main part.

An upwardly projecting thin elastic portion 142 is provided at the lower edge of the opening 1411 in the guide portion 141 so as to be elastically deformed in a vertical direction. The elastic portion 142 can elastically be deformed by providing a hole portion 143 directly therebelow. A rearward opening in the guide portion 141 is closed by a wall portion 131 provided at a lower portion of the casing 13 by fixing the cover 14 to the casing 13 (refer to FIG. 8). According thereto, the child lever 20 is prevented from being dislodged from the guide portion 141.

Incidentally, in this embodiment, the guide portion 141 is formed by the straight-line elongate groove. Alternatively, the guide portion 141 may be formed by an elongate hole or cutout which extends in a straight-line fashion in the front-to-rear direction.

The outside lever 21 is pivotally supported by a shaft portion 132 which projects rearwards at a lower portion of a surface of the casing 13 which is oriented to the rear thereof (a surface oriented rightwards in FIG. 2). The outside handle, which is provided on an outer side of the door to be operated to open the door, is connected to an outward connecting portion 211 provided at an outward end portion of the outside lever 21 via a vertically oriented operation force transmitting member (not shown). According thereto, when the outside handle is operated to open the door, the outside lever 21 rotates about the shaft portion 132 through a predetermined angle from an initial position (a position where an inward end portion 212 is in a position shown in FIGS. 3, 4) in an opening direction (a direction in which the inward end portion 212 moves upwards in FIGS. 3, 4) against a pressing force of a spring disposed around the shaft portion 132. Further, a passive opening portion 213 is provided below the inward end portion 212 of the outside lever 21 with which a connecting projecting portion 206 (which will be described later) can be brought into abutment from therebelow when the child lever 20 is in the unlocking position (which will be described later).

The lock lever 17 is pivotally supported by a shaft portion 134 which is oriented towards the inside and outside of the passenger compartment between the casing 13 and the cover 14. The lock lever 17 can rotate between an unlocking position (for example, refer to FIG. 3) and a locking position (refer to FIG. 4) which is reached after rotation through a predetermined angle from the unlocking position in a counterclockwise direction based on a manual operation of a lock knob provided on the inner side of the door and power from the motor 15. The lock lever 17 is elastically held in the unlocking position and the locking position by a pressing force of a spring 24 supported on the casing 13. Incidentally, stoppers (not shown) are provided on the casing 13 so as to stop the lock lever 17 at the unlocking position and the locking position.

An end portion of an operation force transmitting member 25, which is formed by a cable or the like connected to the lock knob, is connected to a connecting portion 171. The connecting portion 171 is provided at a portion of the lock lever 17 which extends obliquely forwards and downwards so as to input an operation force of the lock knob.

Further, the lock lever 17 includes a projecting portion 173 and first and second engagement arm portions 174, 175. The projecting portion 173 is slidably engaged in a vertical guide groove 181 provided on the opening link 18 on a side of an operating arm portion 172 which extends upwards. The first and second engagement arm portions 174, 175 extend in a centrifugal direction from a rotation center of the lock lever 17.

The worm wheel 16 is pivotally supported on a shaft portion 135 which is oriented towards the inside and outside of the passenger compartment between the casing 13 and the cover 14. The worm wheel 16 meshes with a worm 151 which is fixedly secured to a rotating shaft of the motor 15 and rotates forwards and backwards by means of power from the motor 15.

A pair of first engagement projecting portions 161, 161 are provided on one (facing the cover 14) of rotating surfaces of the worm wheel 16 so as to be brought into abutment with the first engagement arm portion 174 of the lock lever 17. In addition, a pair of second engagement projecting portion (not shown) are provided on the other rotating surface (facing the casing 13) of the worm wheel 16 which is opposite to the rotating surface where the first engagement projecting portions are provided so as to be brought into abutment with the second engagement arm portion 175.

In a state where the lock lever 17 is in the unlocking position as shown in FIG. 3, when an operation switch provided inside the passenger compartment or a portable operation switch is operated to effect locking and the motor 15 rotates to rotate the worm wheel 16 in a locking direction (a clockwise direction in FIG. 3), the first engagement projecting portion 161 located on an upper side is brought into abutment with the first engagement arm portion 174 in a rotating direction. By this abutment, the lock lever 17 rotates in a locking direction (a counterclockwise direction in FIG. 4) and stops in the unlocking position.

In a state where the lock lever 17 is in the locking position as shown in FIG. 4, when the operation switch is operated to effect unlocking, the worm wheel 16 rotates in an unlocking direction (a counterclockwise direction in FIG. 4), whereby the second engagement portion is brought into abutment with the second engagement arm portion 175 in the rotating direction. By this abutment, the lock lever 17 rotates in an unlocking direction (a clockwise direction in FIG. 4) and stops in the unlocking position.

In the opening link 18, an hourglass-shaped support hole 182 provided at a lower portion is brought into engagement with the inward end portion 212 of the outside lever 21 so as to swing in the front-to-rear direction. The projecting portion 173 of the lock lever 17 is brought into engagement with the vertical guide groove 181 so as to slide in a vertical direction. Thus, the opening link 18 swings about the inward end portion 212 to an unlocking position (refer to FIG. 3) and a locking position (refer to FIG. 4) while following the movement of the lock lever 17 to the unlocking position and the locking position, and the opening link 18 moves in an opening direction (upwards) based on the rotation of the outside lever 21 in the opening direction.

A cancellation portion 183 is provided at a vertically central and rear portion of the opening link 18 so as to be brought into abutment with a rotating portion 111 of the opening lever 11 from below when the opening link 18 moves in the opening direction from the unlocking position.

The cancellation portion 183 of the opening link 18 is positioned directly below the rotating portion 111 when the opening link 18 is in the unlocking position. Further, the cancellation portion 183 is positioned forwards and obliquely downwards of the rotating portion 111 when the opening link 18 is in the locking position.

As shown in FIG. 3, when the outside lever 21 rotates in the opening direction and the opening link 18 moves in the opening direction from the unlocking position from the state in which the lock lever 17 and the opening link 18 are in the unlocking position and the outside lever 21 is in an initial position (the inward end portion 212 is in the position shown in FIGS. 3, 4), the cancellation portion 183 is brought into abutment with the rotating portion 111 of the opening link 18 from below. By this abutment, the opening lever 11 rotates in the opening direction, and the ratchet 9 is disengaged from the latchet 7, so as to enable the door to be opened.

In addition, even when the opening link 18 moves in the opening direction from the locking position as the outside lever 21 rotates in the opening direction from the state where the lock lever 17 and the opening link 18 are in the locking position as shown in FIG. 4, the cancellation portion 183 moves transversely in front of the rotating portion 111 of the opening lever 11 to thereby avoid the abutment with the rotating portion 111. Thus, the opening lever 11 does not rotate in the opening direction, and hence, the door cannot be opened.

The inside lever 19 is pivotally supported on a shaft portion 133 is provided on the casing 13 at a portion which faces the guide portion 141 in the cover 14 and which projects towards the inside of the passenger compartment. An operation force transmitting member 23, which is formed by a cable which can transmit an operation force of the inside handle provided on the inner side of the door to be operated to open the door, is connected to a connecting portion 192 provided at a lower portion of the inside lever 19. Thus, the inside lever 19 rotates through a predetermined angle in an opening direction (a clockwise direction in FIGS. 3, 4) from an initial position (refer to FIGS. 3, 4) in accordance with a door opening operation of the inside handle. The side wall portion 1414 of the cover 14 which faces the shaft portion 133 is fixed to a distal end of the shaft portion 133 from the inside of the passenger compartment with a bolt 26.

Provided on the inside lever 19 includes an active opening portion 191 which can be brought into abutment with the passive opening portion 213 of the outside lever 21 via the connecting projecting portion 206 of the child lever 20 when the child lever 20 is in the unlocking position.

Figure 13:
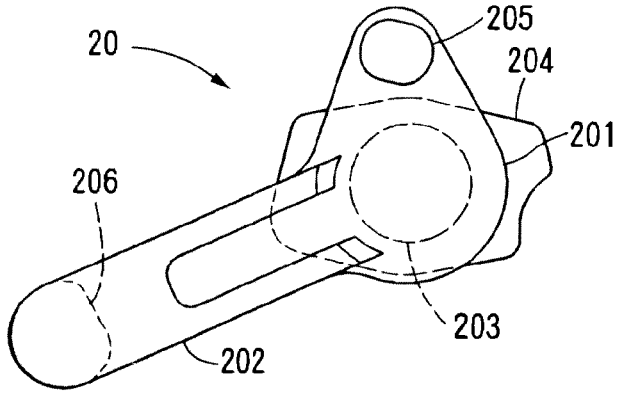
FIG. 13 is a front view of the child lever.
Figure 14:
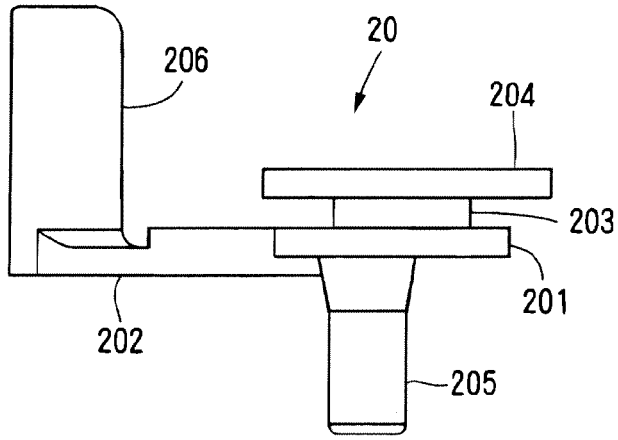
FIG. 14 is a plan view of the child lever.
Figure 15:
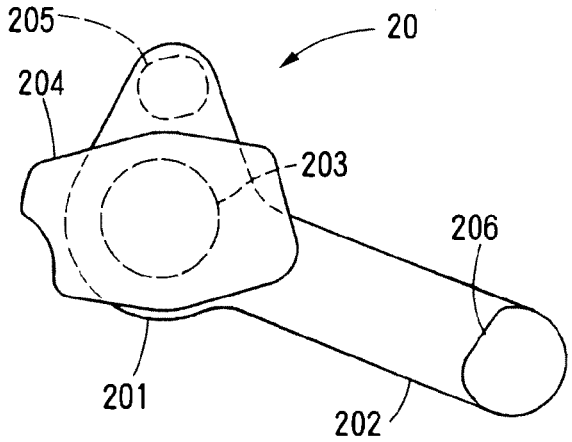
FIG. 15 is a back view of the child lever.

FIGS. 13 to 15 show a front view, a plan view and a back view of the child lever 20, respectively. The child lever 20 includes: a flat base portion 201; an arm portion 202 that extends to the front from the base portion 201; a circular shaft portion 203, which is provided on a back side (a side facing the outside of the passenger compartment) of the base portion 201 so as to project therefrom, and which configures a rotation center of the child lever 20 so that the child lever 20 rotates about the circular shaft portion 203; the slider portion 204 that is provided at a distal end of the circular shaft portion 203 lies on a side facing the outside of the passenger compartment; an operation portion 205 that is provided on a front side (a side facing the inside of the passenger compartment) of the base portion 201 so as to project to the inside of the passenger compartment; and the connecting projecting portion 206 that projects towards the outside of the passenger compartment. The flat base portion 201, the arm portion 202, the circular shaft portion 203, the slider portion 205, the operation portion 205 and the connecting projecting portion 206 are integrally provided. The operation portion 205 is provided in vicinity of the circular shaft portion 203 (i.e., a distance between the operation portion 205 and the circular shaft portion 203 may be shorter than a distance between the connecting projecting portion 206 and the circular shaft portion 203). By the circular shaft portion 203 being fitted in the opening 1411 in the guide portion 141 in the cover 14 and the slider portion 204 being fitted between the bottom surface portion 1412 and the ceiling surface portion 1213 so as to slide in the front-to-rear direction, respectively, the child lever 20 is supported so as to be displaced in a straight-line fashion between an unlocking position shown in FIGS. 1, 3 to 5 and 9 and a locking position shown in FIGS. 6 to 8 and 10 against an elastic force of the elastic portion 142 of the cover 14.

Incidentally, in the following description, a state in which the child lever 20 is in the unlocking position may from time to time be referred to as a childproof lock unlocked state. Similarly, a state in which the child lever 20 is in the locking position may from time to time be referred to as a childproof lock locked state.

Figure 16:
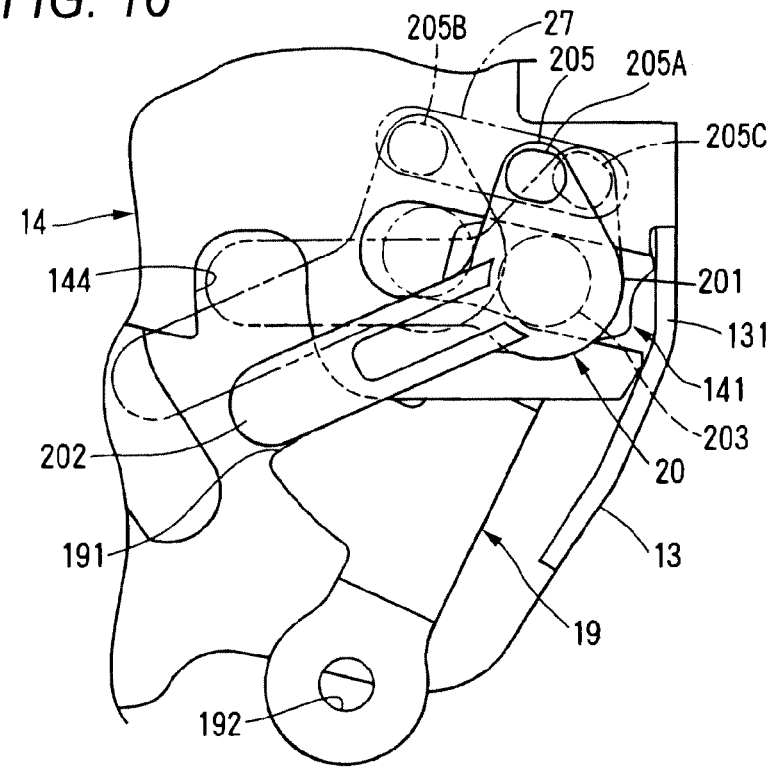
FIG. 16 is an explanatory diagram depicting an operation of the child lever.

As can be understood particularly from FIG. 15, in the slider portion 204, an upper edge which is brought into slidable contact with the ceiling surface portion 1413 of the guide portion 141 is formed into an upwardly projecting angled portion, and a lower edge which is brought into slidable contact with the bottom surface portion 1412 of the guide portion 141 is formed into a downwardly projecting angled portion. According thereto, by the slider portion 204 being inserted between the bottom surface portion 1412 and the ceiling surface portion 1413 of the guide portion 141, the child lever 20 is supported by the guide portion 141 so as to rotate through a predetermined angle in the opening direction (in the direction in which the arm portion 202 moves upwards) about the circular shaft portion 204 from a standby position (a position where the arm portion 202 is oriented obliquely downwards) but so as not to rotate in an opposite direction to the opening direction (refer to FIG. 16). However, when the child lever 20 is in the locking position, the connecting projecting portion 206 is located in a position where it can be brought into abutment with a preventing portion 145 provided at the front of the escape hole 144 in the cover 14. According thereto, the child lever 20 is prevented from rotating in the opening direction.

The operation portion 205 is provided at an upper portion of the base portion 201 so that the operation portion 25 projects from a panel hole 27 (refer to FIG. 16) provided in an inner panel of the door so as to be manually operated with the door opened and is displaced to the rear along a longitudinal direction of the guide portion 141 when the child lever 20 rotates in the opening direction from the standby position in the unlocking position. By this configuration, as clearly shown in FIG. 16, a position 205A of the operation portion 205 when the child lever 20 is in the unlocking position, a position 20513 of the operation portion 25 when the child lever 20 is in the locking position and a position 205C of the operation portion 25 when the child lever 20 rotates in the opening direction from the standby position in the locking position connect to each other in a straight-line fashion along the front-to-rear direction, that is, the longitudinal direction of the guide portion 141. According thereto, the panel hole 27 in the door which permits the movement of the operation portion 205 can be formed into a straight line, and the external appearance thereof can be improved.

Figure 17:
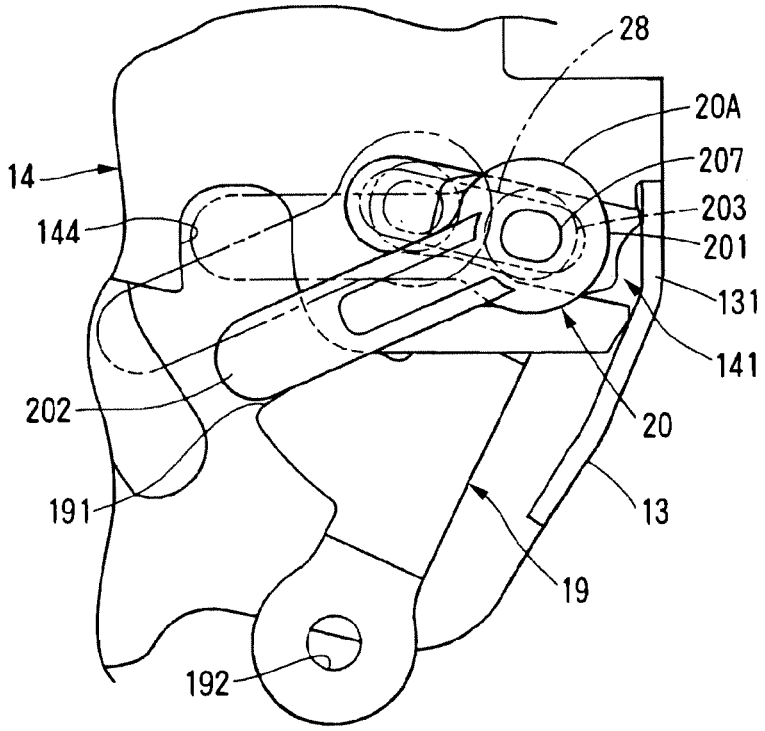
FIG. 17 is an explanatory diagram depicting the operation of a child lever of another embodiment.

In addition, as in the case of another embodiment shown in FIG. 17, when an operation portion 207 of a child lever 20 is provided on a center line of a circular shaft portion 203, it is possible to configure so that the operation portion 207 only rotates in that position while the position of the operation portion 207 is not substantially displaced even when the child lever 20 rotates in an opening direction from a standby position in an unlocking position 20A. By adopting this configuration, a panel hole 208 provided in a door panel to permit the movement of the operation portion 207 can be made smaller, so that the external appearance thereof can be further improved.

Figure 9:
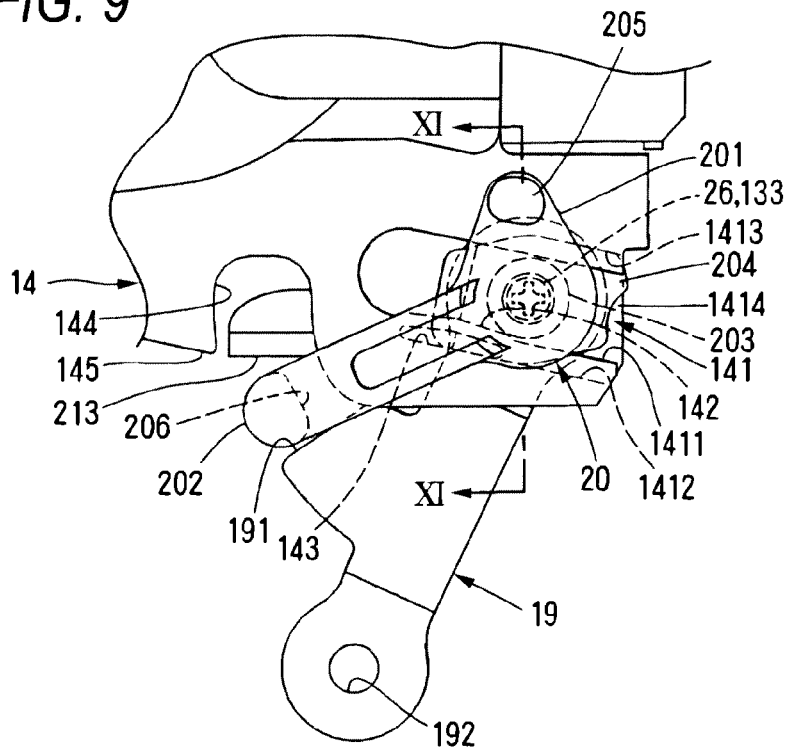
FIG. 9 is an enlarged front view of the main part when the child lever is in the unlocking position.

When a lock lever 17 and an opening link 18 are in unlocking positions as shown in FIG. 3 and a childproof lock unlocked state is present, a base portion 201 of the child lever 20 is located at a rear portion of a guide portion 141 as shown in FIG. 9, a circular shaft portion 203 is held in a position which coincides with an axis of a shaft portion 133 which configures a rotation center of an inside lever 19, and a connecting projecting portion 206 enters between an active opening portion 191 of the inside lever 19 and a passive opening portion 213 of an outside lever 21.

Figure 5:
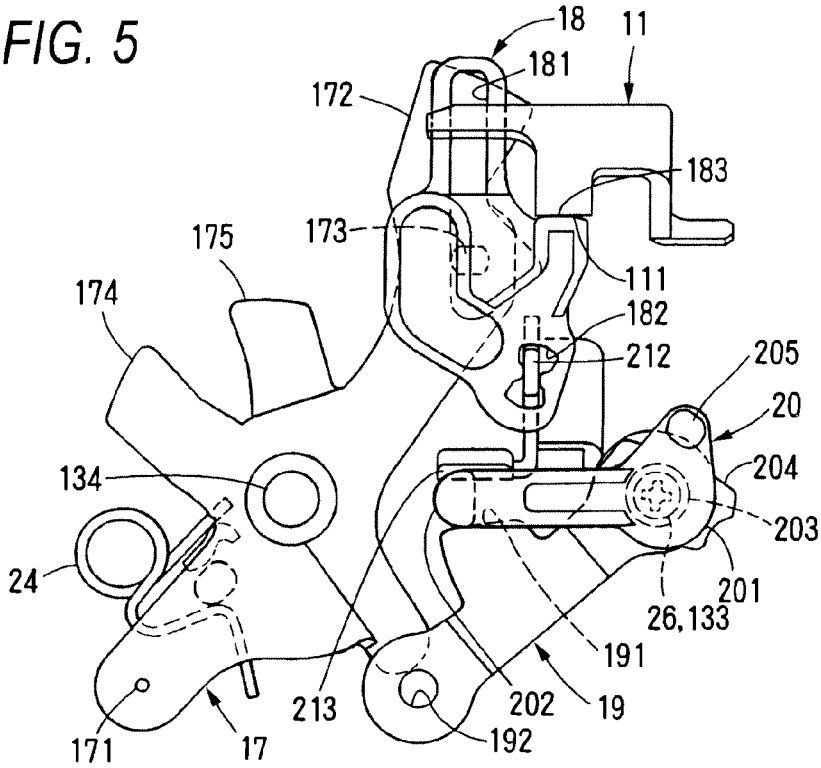
FIG. 5 is an enlarged front view of a main part of the door latch apparatus when the inside handle is operated to open a door in such a state that the lock lever and the opening link are in the unlocking position and the child lever is in the unlocking position.

In the above state, as shown in FIG. 5, when the inside lever 19 rotates in an opening direction from a standby position (a position shown in FIG. 3) about the shaft portion 133 in accordance with the door opening operation of the inside handle, the active opening portion 191 is brought into abutment with the connecting projecting portion 206. Then, the child lever 20 rotates in a clockwise direction (in an opening direction) about the circular shaft portion 203, and the rotation of the child lever 20 is transmitted to an opening lever 11 via an outside lever 21 and the opening link 18 as a result of the connecting projecting portion 206 being brought into abutment with the passive opening portion 213. In this childproof lock unlocked state, since the inside lever 19 and the child lever 20 rotate about the same axis, both the levers 19, 20 can rotate smoothly. According thereto, the door can be opened smoothly as the inside door handle is operated to open the door.

Figure 6:
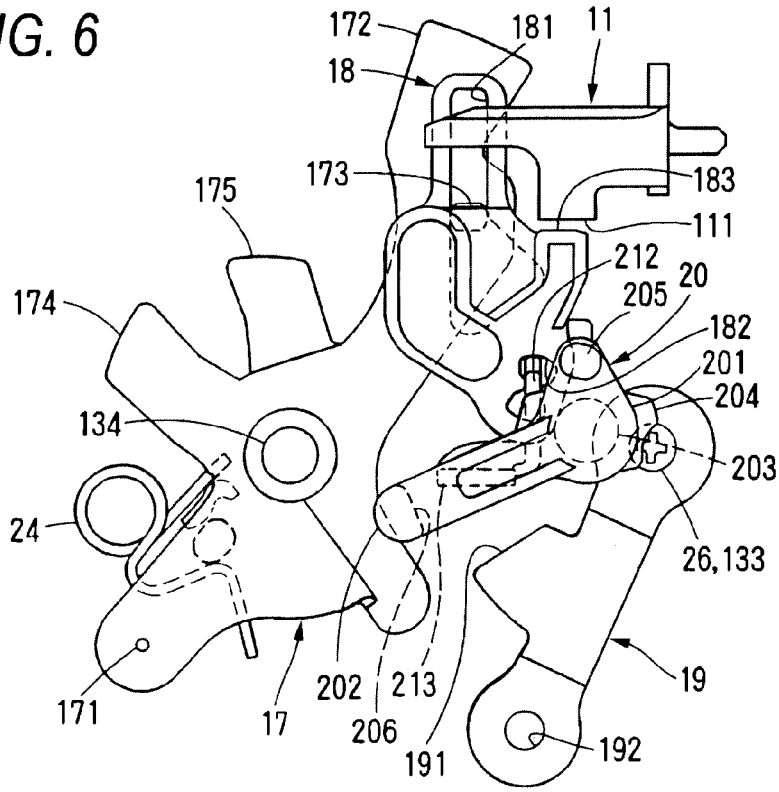
FIG. 6 is an enlarged front view of the main part when the lock lever and the opening link are in the unlocking position and the child lever is in a locking position.
Figure 7:
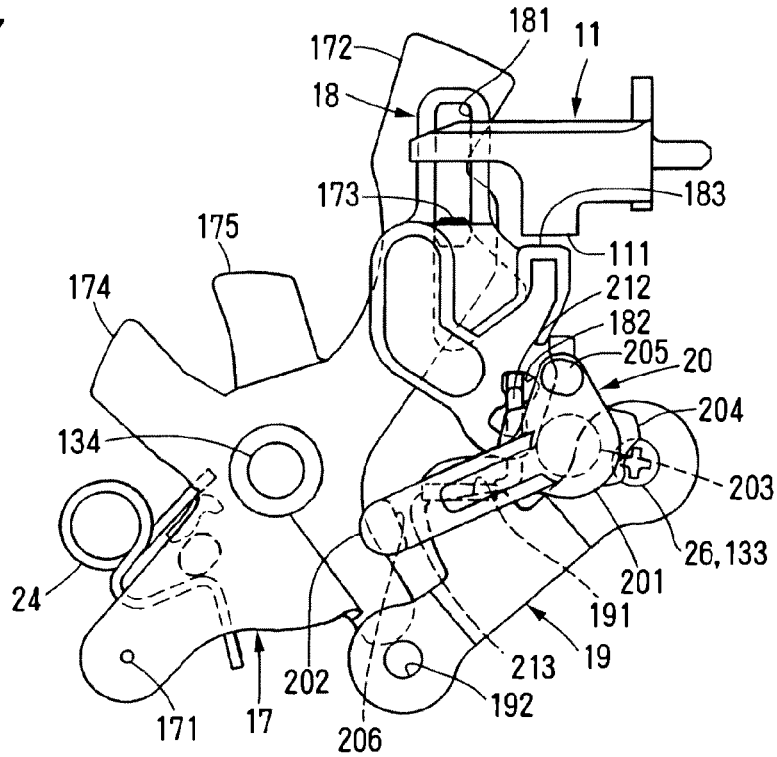
FIG. 7 is an enlarged front view of the main part when the inside handle is operated to open the door in such a state that the lock lever and the opening link are in the unlocking position and the child lever is in the locking position.
Figure 10:
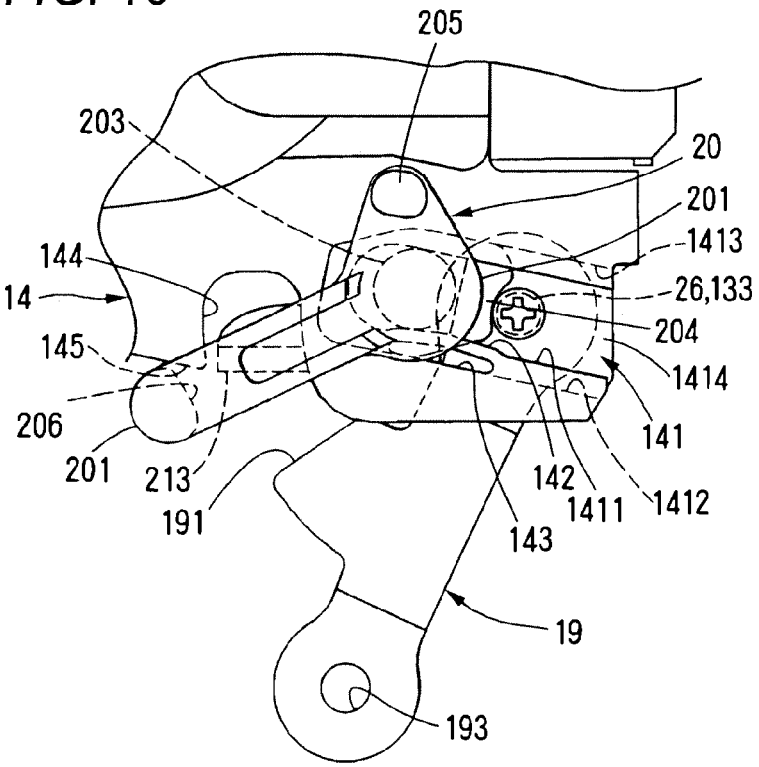
FIG. 10 is an enlarged front view of the main part when the child lever is in the locking position.

When the lock lever 17 and the opening link 18 are in the unlocking positions as shown in FIG. 6 and a childproof lock locked state is present, the base portion 201 of the child lever 20 is at a front portion of the guide portion 141 as shown in FIG. 10, the circular shaft portion 203 is held in a position offset from the axis of the shaft portion 133 which is the rotation center of the inside lever 19, and the connecting projecting portion 206 is withdrawn from between the active opening portion 191 of the inside lever 19 and the passive opening portion 213 of the outside lever 21. By the withdrawal of the connecting projecting portion 206, even when the inside lever 19 rotates in the opening direction from a standby position (a position shown in FIG. 6) as the inside handle is operated to open the door, the active opening portion 191 fails to be brought into abutment with the connecting projecting portion 206, whereby the child lever 20 does not rotate. Consequently, the rotation of the inside lever 19 is not transmitted to the opening lever 11.

Thus, in the embodiments, the child lever 20 is supported slidably and rotatably on the cover 14 so as to be moved between the unlocking position where the child lever 20 is allowed to rotate together with the inside lever 19 so as to transmit the rotation of the inside lever 19 to the opening lever 11 and the locking position where the child lever 20 is restricted from rotating together with the inside lever 19 so as not to transmit the rotation of the inside lever 19 to the opening lever 11. Consequently, when the childproof lock locked state is present, no action occurs in the child lever 20 even when the inside lever 19 rotates. By this configuration, in the childproof lock locked state, the idle operation in which the rotation of the inside lever 19 is not transmitted to the opening lever 11 can be carried out smoothly, and the childproof lock locked state can be ensured.

What is claimed is:

1. A vehicle door latch apparatus that enables a door to be opened by operating an opening member to release a latch in accordance with a door opening operation of an inside door handle provided inside a passenger compartment, the vehicle door latch apparatus comprising:

an inside lever, which is pivotally supported by a first base member, and which is rotatable in accordance with the door opening operation of the inside door handle; and a child lever that comprises an operation portion, the child lever being supported slidably and rotatably on a second base member such that an axis of rotation of the child lever translates along a straight-line guide portion of the second base member, and adapted to pass through a panel hole provided in the door to be exposed to an outside, wherein the child lever is linearly movable to:

an unlocking position where the child lever is allowed to rotate together with the inside lever so as to transmit rotation of the inside lever to the opening member; and a locking position where the child lever is not allowed to rotate together with the inside lever so as not to transmit the rotation of the inside lever to the opening member, and wherein the child lever comprises a connecting projecting portion, which is allowed to be brought into abutment with the inside lever so that the child lever can rotate together with the inside lever when the child lever is in the unlocking position, and which is not allowed to be brought into abutment with the inside lever irrespective of the rotation of the inside lever when the child lever is in the locking position.

2. The vehicle door latch apparatus according to claim 1, wherein the straight-line guide portion of the second base member aligns with a rotating plane of the inside lever, and wherein the child lever is supported in the straight-line guide portion slidably and rotatably.

3. The vehicle door latch apparatus according to claim 2, wherein the straight-line guide portion comprises:

a portion that aligns with a rotation center of the inside lever; and a portion that is offset from the rotation center of the inside lever, and wherein when the child lever is in the unlocking position, the child lever is configured to be held rotatably in the portion that aligns with the rotation center of the inside lever.

4. The vehicle door latch apparatus according to claim 3, wherein the operation portion of the child lever is provided at a portion which moves along a longitudinal direction of the straight-line guide portion when the child lever rotates together with the inside lever in the unlocking position.

5. The vehicle door latch apparatus according to claim 3, wherein the operation portion of the child lever is provided at a rotation center of the child lever when the child lever rotates together with the inside lever in the unlocking position.

6. The vehicle door latch apparatus according to claim 1, wherein the second base member comprises an elastic portion that is adapted to elastically hold the child lever in the unlocking position and the locking position by being brought into elastic abutment with the child lever.

7. The vehicle door latch apparatus according to claim 1, wherein when the child lever is in the locking position, the child lever is configured to be brought into abutment with the second base member so as to be prevented from rotating.

8. The vehicle door latch apparatus according to claim 1, wherein the child lever further comprises a shaft portion that is projected from one side thereof and configures a rotation center thereof, and wherein the straight-line guide portion of the second base member is configured to:

support the shaft portion so as to allow rotation of the child lever around the shaft portion; and guide the shaft portion so as to linearly move the child lever to the unlocking position and the locking position.

9. The vehicle door latch apparatus according to claim 1, wherein the operation portion is provided at a first end portion of the child lever, and the connecting projecting portion is provided at a second end portion of the child lever that is opposite to the first end portion.

* * * * *